US010043441B2

(12) United States Patent
Kim et al.

(10) Patent No.: US 10,043,441 B2
(45) Date of Patent: Aug. 7, 2018

(54) PIXEL, ORGANIC LIGHT EMITTING DISPLAY DEVICE, AND DRIVING METHOD THEREOF

(71) Applicant: SAMSUNG DISPLAY CO., LTD., Yongin-si, Gyeonggi-do (KR)

(72) Inventors: Tae Jin Kim, Yongin-si (KR); Jong Soo Kim, Yongin-si (KR); Myoung Seop Song, Yongin-si (KR); Myung Ho Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 239 days.

(21) Appl. No.: 15/048,475

(22) Filed: Feb. 19, 2016

(65) Prior Publication Data

US 2016/0379552 A1 Dec. 29, 2016

(30) Foreign Application Priority Data

Jun. 29, 2015 (KR) ..... 10-2015-0092527

(51) Int. Cl.
*G09G 3/3208* (2016.01)
*G09G 3/3225* (2016.01)

(52) U.S. Cl.
CPC ..... *G09G 3/3208* (2013.01); *G09G 3/3225* (2013.01); *G09G 2330/02* (2013.01)

(58) Field of Classification Search
CPC ..... G09G 2320/0252; G09G 3/30; G09G 3/3208; G09G 2330/02; G09G 3/3225; G09G 3/32; G09G 3/22; G09G 3/20; G09G 3/00; G09G 2330/00; G09G 2330/025; G09G 2330/026; G09G 2330/028; G09G 2330/012
See application file for complete search history.

(56) References Cited

U.S. PATENT DOCUMENTS 7,061,452 B2 * 6/2006 Inoue ..... G09G 3/3233 345/207
7,737,923 B2 * 6/2010 Shishido ..... G09G 3/3241 345/76
7,816,687 B2 * 10/2010 Chun ..... H01L 21/268 257/59

(Continued)

FOREIGN PATENT DOCUMENTS

KR 10-2012-0009904 A 2/2012
KR 10-2013-0046006 A 5/2013
KR 10-2014-0137504 A 12/2014

*Primary Examiner* — Julie Anne Watko
(74) *Attorney, Agent, or Firm* — Lewis Roca Rothgerber Christie LLP

(57) ABSTRACT

A pixel including: an organic light emitting diode; a first transistor configured to control an amount of current that passes through the organic light emitting diode to flow to a second power from a first power that is connected to a first electrode of the first transistor corresponding to a voltage of a first node; a second transistor between a data line and the first node; a third transistor between the first node and a reference power; a fourth transistor between a second node and an initialization power, the second node being connected to an anode electrode of the organic light emitting diode; a first capacitor; and a second capacitor connected in series to the first capacitor, the first and second capacitors being between the first node and the first power.

19 Claims, 5 Drawing Sheets

(56) References Cited

U.S. PATENT DOCUMENTS 7,944,418 B2 * 5/2011 Chung ..... G09G 3/3233 315/169.3
8,432,389 B2 * 4/2013 Yamamoto ..... G09G 3/3233 345/204
8,797,238 B2 * 8/2014 Kwak ..... G09G 3/3233 345/30
8,803,768 B2 * 8/2014 Kimura ..... H01L 27/1225 345/76
8,895,984 B2 * 11/2014 Kwak ..... H01L 27/12 257/59
8,994,029 B2 * 3/2015 Kimura ..... G09G 3/3233 257/59
9,007,283 B2 * 4/2015 Choi ..... G09G 3/3233 327/91
9,111,893 B2 * 8/2015 Ebisuno ..... G09G 3/3233
9,184,186 B2 * 11/2015 Shishido ..... G09G 3/3233
9,324,266 B2 * 4/2016 Hwang ..... G09G 3/003
9,496,324 B2 * 11/2016 Iida ..... G09G 3/3233
2003/0132931 A1 * 7/2003 Kimura ..... G09G 3/2022 345/212
2006/0154422 A1 * 7/2006 Chun ..... H01L 21/268 438/274
2007/0024544 A1 * 2/2007 Chung ..... G09G 3/3233 345/76
2007/0085847 A1 * 4/2007 Shishido ..... G09G 3/3233 345/204
2009/0039355 A1 * 2/2009 Kwak ..... G09G 3/3233 257/72
2009/0122053 A1 * 5/2009 Yamamoto ..... G09G 3/3233 345/213
2012/0019498 A1 1/2012 Jeong
2012/0162275 A1 * 6/2012 Park ..... H01L 27/3265 345/690
2013/0106828 A1 5/2013 Kim
2013/0194248 A1 8/2013 Kim
2013/0320847 A1 * 12/2013 Iida ..... G09G 3/3233 315/51
2013/0321248 A1 * 12/2013 Kimura ..... H01L 33/0041 345/76
2014/0203262 A1 * 7/2014 Kwak ..... G09G 3/3233 257/40
2014/0232762 A1 * 8/2014 Park ..... H01L 27/3265 345/690
2014/0292827 A1 * 10/2014 Kang ..... G09G 3/20 345/690
2014/0306945 A1 * 10/2014 Kishi ..... G09G 3/30 345/211
2014/0347347 A1 11/2014 Jeong et al.
2015/0053953 A1 * 2/2015 Ebisuno ..... G09G 3/3233 257/40
2015/0090996 A1 * 4/2015 Kimura ..... G09G 3/3233 257/40
2015/0187432 A1 * 7/2015 Jinta ..... G09G 3/3233 345/77
2015/0279279 A1 * 10/2015 Toyomura ..... G09G 3/3233 345/212
2017/0316741 A1 * 11/2017 Kishi ..... G09G 3/3275

* cited by examiner

PIXEL, ORGANIC LIGHT EMITTING DISPLAY DEVICE, AND DRIVING METHOD THEREOF

CROSS-REFERENCE TO RELATED APPLICATION

This application claims priority to, and the benefit of, Korean Patent Application No. 10-2015-0092527, filed on Jun. 29, 2015, in the Korean Intellectual Property Office, the entire contents of which are incorporated herein by reference in their entirety.

BACKGROUND

1. Field

Exemplary embodiments of the present invention relate to a pixel, an organic light emitting display device including the pixel, and a driving method thereof. More particularly, the embodiments of the present invention relate to a pixel that can improve image quality, an organic light emitting display device including the pixel, and the driving method thereof.

2. Description of the Related Art

With the development of information technology, the importance of a display device, which is a connection medium between a user and information, has increased. Accordingly, the use of a flat panel display, such as a liquid crystal display, an organic light emitting display device, and a plasma display panel, has increased.

The organic light emitting display device uses organic light emitting diodes that generate light through reunion of electrons and holes, and has features of fast response speed and low power consumption.

The organic light emitting display device includes a plurality of pixels that are disposed at regions that are defined by data lines and scan lines. The pixels consist of at least two transistors and at least one capacitor, and generally include an organic light emitting diode and a driving transistor.

The organic light emitting display device has a feature that power consumption is lower, but an amount of current that flows to the organic light emitting diode may be varied depending on a threshold voltage variation of the driving transistor that is included in the pixel, which may cause a non-uniform display. That is, the characteristics of the driving transistor may be changed depending on the manufacturing process of the driving transistor in the pixels. Further, it may be difficult or impossible to make all transistors of the organic light emitting display device have equal characteristics, and a threshold voltage deviation of the driving transistor is generated thereby.

A method that adds a compensation circuit consisting of a plurality of transistors and capacitors at each pixel has been introduced to overcome this problem. The compensation circuit included in each pixel charges a voltage corresponding to a threshold voltage of the driving transistor for a first horizontal period, and compensates the deviation of the driving transistor accordingly.

However, as the panel is larger and has high resolution, the time that is allocated for the first horizontal period is reduced, and the threshold voltage of the driving transistor is not sufficiently compensated.

The above information disclosed in this Background section is only for enhancement of understanding of the background of the invention and therefore it may contain information that does not form prior art.

SUMMARY

Embodiments of the present invention may provide a pixel, an organic light emitting display device including the pixel, and a driving method thereof having features of improved display quality.

A pixel according to an exemplary embodiment of the present invention may include an organic light emitting diode, a first transistor configured to control an amount of current that passes through the organic light emitting diode to flow to a second power from a first power that is connected to a first electrode of the first transistor corresponding to a voltage of a first node, a second transistor between a data line and the first node, a third transistor between the first node and a reference power, a fourth transistor between a second node and an initialization power, the second node being connected to an anode electrode of the organic light emitting diode, a first capacitor, and a second capacitor connected in series to the first capacitor, the first and second capacitors being between the first node and the first power, wherein a third node that is a common node of the first capacitor and second capacitor is electrically connected to the first electrode of the first transistor.

The reference power have a voltage at which the first transistor is turned on.

The initialization power have a voltage at which the organic light emitting diode is turned off.

The third transistor and the fourth transistor may be concurrently turned on and turned off and their turned-on period does not overlap a turned-on period of the second transistor.

The third transistor and the fourth transistor may be turned on before the second transistor is turned on.

The pixel may include a fifth transistor between the third node and the first power, and a sixth transistor between the second node and the first transistor.

The turned-on period of the fifth transistor may not overlap that of the second transistor, and the fifth transistor may be turned off after the third transistor is turned on.

The sixth transistor may be turned off when the second transistor is turned on.

The pixel may include a fifth transistor between the third node and the first power, and a sixth transistor between the second node and the organic light emitting diode.

The turned-on period of the fifth transistor may not overlap that of the second transistor, and the fifth transistor may be turned off after the third transistor is turned on.

The turned-on period of the sixth transistor may not overlap that of the second transistor and the third transistor.

An organic light emitting display device according to an exemplary embodiment of the present invention may include pixels disposed in regions that are defined by scan lines, data lines, control lines, first light emitting control lines, and second light emitting control lines, a scan driver configured to supply scan signals to the scan lines, a data driver configured to supply data signals to the data lines, and a control line driver configured to supply control signals to the control lines, wherein each pixel at an i-th horizontal line (i is natural number) includes an organic light emitting diode, a first transistor configured to control an amount of current that passes through the organic light emitting diode to flow to a second power from a first power that is connected to a first electrode of the first transistor corresponding to a voltage of a first node, a second transistor between a data line of the data lines and the first node and configured to be turned on when a scan signal of the scan lines is supplied to an i-th scan line, a third transistor between the first node and a reference power and configured to be turned on when a control signal of the control signals is supplied to an i-th control line, a fourth transistor between a second node and an initialization power and configured to be turned on when the control signal of the control signals is supplied to the i-th control line, the second node being connected to an anode electrode of the organic light emitting diode, a first capacitor, a second capacitor connected in series to the first capacitor, the first and second capacitors being between the first node and the first power, and a third node that is a common node of the first capacitor and second capacitor and that is electrically connected to the first electrode of the first transistor.

The reference power may have a voltage at which the first transistor is turned on.

The initialization power may have a voltage at which the organic light emitting diode is turned off.

The scan driver may sequentially supply the scan lines with scan signals, and, the control line driver may supply the i-th control line with the control signal having a wider width than that of the scan signal, the control signal being supplied before the scan signal is supplied to the i-th scan line.

Each pixel at the i-th horizontal line (i is natural number) may include a fifth transistor between the third node and the first power and configured to be turned off when a first light emitting control signal is supplied to an i-th first light emitting control line of the first light emitting control lines and to be turned on for other periods, and a sixth transistor between the second node and the first transistor and configured to be turned off when a second light emitting control signal is supplied to an i-th second light emitting control line of the second light emitting control lines and to be turned on for other periods.

The organic light emitting display device according to an exemplary embodiment may include an emission driver that supplies the first light emitting control signal to the i-th light emitting control line such that a part thereof overlaps the control signal supplied to the i-th control line and another part thereof overlaps the scan signal supplied to the i-th scan line and supplies the second light emitting signal to the i-th second light emitting control line such that a part thereof overlaps the scan signal supplied to the i-th scan line.

Each pixel at an i-th horizontal line (i is natural number) may include a fifth transistor between the third node and the first power and configured to be turned off when a first light emitting control signal is supplied to an i-th first light emitting control line of the first light emitting control lines and to be turned on for other periods, and a sixth transistor between the second node and the anode electrode of the organic light emitting diode and configured to be turned off when a second light emitting control signal is supplied to an i-th second light emitting control line of the second light emitting control lines and to be turned on for other periods.

The organic light emitting display device may include an emission driver that supplies supply the first light emitting control signal to the i-th light emitting control line such that a part thereof overlaps the control signal of the control signals supplied to the i-th control line and another part thereof overlaps the scan signal of the scan signals supplied to the i-th scan line and supplies the second light emitting control signal to the i-th second light emitting control line such that a part thereof overlaps the control signal of the control signals supplied to the i-th control line and the scan signal of the scan signals supplied to the i-th scan line.

A method of driving an organic light emitting display device including pixels at horizontal lines, the method including initializing a driving transistor in a pixel of the pixels to an ON-bias condition, compensating for a threshold voltage of the driving transistor, and charging at least one capacitor connected to the driving transistor with a voltage corresponding to a data signal, wherein at least one part of the initializing and the compensating of the pixels that are at an i+1-th horizontal line (i is natural number) overlaps the compensating of the pixels that are at an i-th horizontal line.

A pixel, an organic light emitting display device using this, and the driving method thereof according to an exemplary embodiment of the present invention compensates a threshold voltage of a driving transistor regardless of a period that a data signal is supplied. That is, a threshold voltage of a driving transistor is compensated for sufficient time before a data signal is supplied, and a display quality can be improved accordingly.

BRIEF DESCRIPTION OF THE DRAWINGS

Example embodiments will be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art. In the drawing figures, dimensions may be exaggerated for clarity of illustration. Like reference numerals refer to like elements (or components) throughout.

DETAILED DESCRIPTION

Figure 1:
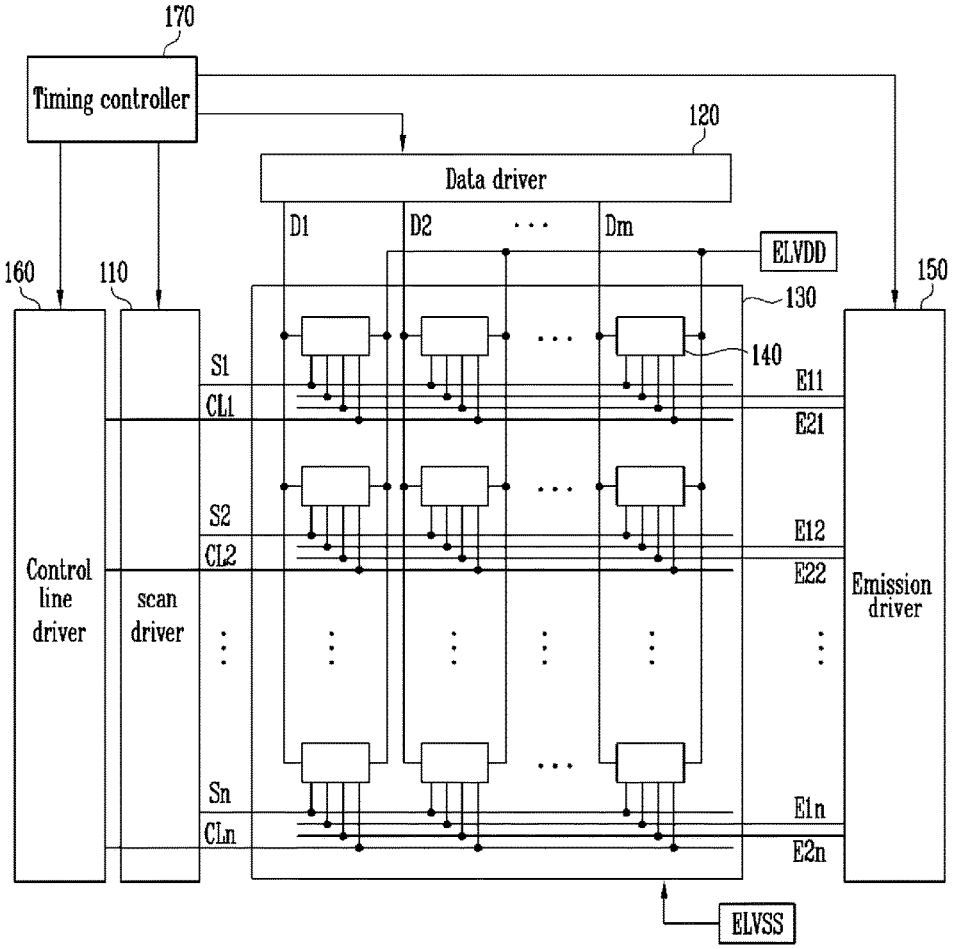
FIG. 1 is a block diagram showing an organic light emitting display device according to an exemplary embodiment of the present invention.

Hereinafter, one or more embodiments of the present invention will be described, with reference to the accompanying drawings, to enable those skilled in the art to implement the invention. However, as those skilled in the art would realize, the described embodiment may be modified in various suitable ways, all without departing from the spirit or scope of the present invention.

That is, the present invention is not limited by the hereafter-disclosed exemplary embodiments, and may be modified in various suitable ways.

It will be understood that, although the terms "first", "second", "third", etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer, or section discussed below could be termed a second element, component, region, layer, or section, without departing from the spirit and scope of the present invention.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

FIG. 1 is a block diagram showing an organic light emitting display device according to an exemplary embodiment of the present invention.

Referring to FIG. 1, an organic light emitting display device according to an exemplary embodiment of the present invention is provided with a pixel portion 130 including a plurality of pixels 140, a scan driver 110 for driving scan lines (S1 to Sn), a data driver 120 for driving data lines (D1 to Dm), an emission driver 150 for driving first light emitting control lines (E11 to E1*n*) and second light emitting control lines (E21 to E2*n*), a control line driver 160 for driving control lines (CL1 to CLn), and a timing controller 170 for controlling drivers 110, 120, 150, and 160.

A pixel portion 130 denotes a display region of an organic light emitting display device. A pixel portion 130 is provided with pixels 140 that are at respective regions that are defined by scan lines (S1 to Sn), data lines (D1 to Dm), control lines (CL1 to CLn), first light emitting control lines (E11 to E1*n*), and second light emitting control lines (E21 to E2*n*).

Each pixel 140 includes a driving transistor. Driving transistors are separately driven by an ON-bias step, a threshold voltage compensating step, a data signal storage step, and a light emitting step. Here, a part of a threshold voltage compensating step of pixels 140 that are disposed at an i-th horizontal line (i is natural number) overlaps the ON-bias step and a threshold voltage compensation step of pixels 140 that are at an i+1-th horizontal line. In this regard, hereinafter, the detailed description will be provided.

The scan driver 110 supplies scan lines (S1 to Sn) with scan signals. For example, the scan driver 110 can sequentially supply scan lines (S1 to Sn) with scan signals. When a scan signal is supplied to scan lines (S1 to Sn), groups of the pixels 140 are selected as a horizontal unit. Additionally, the scan driver 110 supplies an i+1-th scan line Si+1 with a scan signal such that the scan signal does not overlap a scan signal provided to an i-th scan line Si. Here, the scan signal is set to a gate-on voltage such that a transistor included in the pixels 140 can be turned on.

The control line driver 160 supplies control lines (CL1 to CLn) with a control signal. For example, the control line driver 160 sequentially supplies control lines (CL1 to CLn) with a control signal.

The control line driver 160 supplies an i-th control line CLi with a control signal that overlaps a scan signal of the i-th scan line Si, and has a wider width than the scan signal of the i-th scan line Si. For example, the control line driver 160 can supply the i-th control line CLi with the control signal before a scan signal is supplied to the i-th scan line Si. Additionally, because the control signal is set to be wider than a scan signal, the control signal that is supplied to an i+1-th control line CLi overlaps a part of the control signal that is supplied to the i-th control line CLi. The control signal is set to a gate-on voltage such that a transistor included in the pixels 140 can be turned on.

The emission driver 150 supplies first light emitting control lines (E11 to E1*n*) with a first light emitting control signal, and supplies second light emitting control lines (E21 to E2*n*) with a second light emitting control signal. For example, the emission driver 150 sequentially supplies first light emitting control lines (E11 to E1*n*) with first light emitting control signals, and can sequentially supply the second light emitting control lines (E21 to E2*n*) with second light emitting control signals.

Also, the emission driver 150 supplies an i-th first light emitting control line E1*i* with a first light emitting control signal that overlaps a part of the control signal supplied to the i-th control line CLi, and that overlaps a scan signal supplied to the i-th scan line Si. Also, the emission driver 150 supplies an i-th second light emitting control line E2*i* with a second control signal such that this overlaps a scan signal supplied to the i-th scan line Si. Here, a first light emitting control signal and a second light emitting control signal are set to a gate-off voltage such that a transistor included in pixels 140 can be turned off.

The data driver 120 supplies data lines (D1 to Dm) with data signals to be synchronized with the scan signals. Data signals supplied to data lines (D1 to Dm) are supplied to pixels 140 selected by the scan signal. Pixels 140 receiving the data signals generate light with luminance corresponding to the data signals.

A timing controller 170 controls the scan driver 110, the data driver 120, the emission driver 150, and the control line driver 160.

Figure 2:
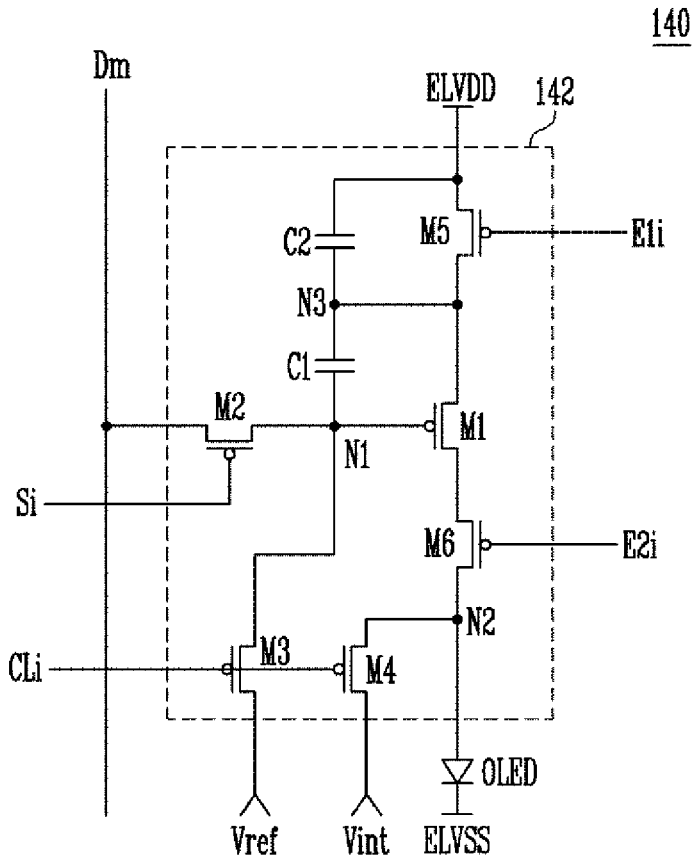
FIG. 2 is a circuit diagram showing a pixel according to an exemplary embodiment of the present invention.

FIG. 2 is a circuit diagram showing a pixel according to an exemplary embodiment of the present invention. A pixel that is connected to an m-th data line Dm and the i-th scan line Si is shown in FIG. 2, for ease of description.

Referring to FIG. 2, the pixel 140 according to an exemplary embodiment of the present invention is provided with a pixel circuit 142 for controlling an amount of current that is supplied to an organic light emitting diode (OLED).

An anode electrode of the organic light emitting diode (OLED) is connected to the pixel circuit 142, and a cathode electrode is connected to a second power ELVSS. This organic light emitting diode (OLED) generates a luminance of light corresponding to the amount of current supplied from the pixel circuit 142. Meanwhile, the second power ELVSS can be set to a voltage lower than a first power ELVDD.

The pixel circuit 142 controls the amount of current supplied to organic light emitting diode (OLED) in accordance with a data signal. For this purpose, the pixel circuit 142 is provided with a first transistor M1 to a sixth transistor M6, a first capacitor C1, and a second capacitor C2.

A first electrode of the first transistor M1 (i.e., a driving transistor) is connected to the first power ELVDD through the fifth transistor M5, and a second electrode of the first transistor M1 is connected to the anode electrode of the organic light emitting diode (OLED) through the sixth transistor M6. A gate electrode of the first transistor M1 is connected to a first node N1. The first transistor M1 controls the amount of current flowing to the second power ELVSS through the organic light emitting diode (OLED) from the first power ELVDD.

A first electrode of the second transistor M2 is connected to the data line Dm, and a second electrode of the second transistor M2 is connected to the first node N1. A gate electrode of the second transistor M2 is connected to the scan line Si. This second transistor M2 connects the data line Dm with the first node N1 when the scan signal is supplied to the scan line Si.

A first electrode of the third transistor M3 is connected to the first node N1, and a second electrode of the third transistor M3 is connected to a reference power Vref. A gate electrode of the third transistor M3 is connected to the control line CLi. This third transistor M3 is turned on to supply the first node N1 with a voltage of the reference power Vref when the control signal is supplied to the control line CLi. Here, the reference power Vref is set to a voltage that is lower than the first power ELVDD, for example, the reference power Vref can be set to a voltage that causes the first transistor M1 to be turned on. As an example, the reference power Vref can be set to a specific value in a voltage range of the data signal.

A first electrode of the fourth transistor M4 is connected to a second node N2, and a second electrode of the fourth transistor M4 is connected to an initialization power Vint. A gate electrode of the fourth transistor M4 is connected to the control line CLi. The fourth transistor M4 is turned on to provide a voltage of the initialization power Vint to the second node N2 when the control signal is supplied to the control line CLi. Here, the second node N2 denotes a node that is electrically connected to the anode electrode of the organic light emitting diode (OLED). And, the initialization power Vint is set to a voltage that causes the organic light emitting diode (OLED) to be turned off.

A first electrode of the fifth transistor M5 is connected to the first power ELVDD, and a second electrode of the fifth transistor M5 is connected to a third node N3. A gate electrode of the fifth transistor M5 is connected to the first light emitting control line E1*i*. This fifth transistor M5 is turned off when the light emitting control signal is supplied to the first light emitting control line E1*i*, and is turned on otherwise. Meanwhile, the third node N3 is electrically connected to the first electrode of the first transistor M1.

A first electrode of the sixth transistor M6 is connected to the second electrode of the first transistor M1, and a second electrode of the sixth transistor M6 is connected to the second node N2. A gate electrode of the sixth transistor M6 is connected to the second light emitting control line E2*i*. The sixth transistor M6 is turned off when the second light emitting control signal is supplied to the second light emitting control line E2*i*, and is turned on otherwise.

The first capacitor C1 and the second capacitor C2 are connected in series between the first node N1 and the first power ELVDD. And, a common terminal of the first capacitor C1 and the second capacitor C2 is electrically connected to the third node N3. The first capacitor C1 and the second capacitor C2 store a voltage corresponding to the threshold voltage of the first transistor M1 and the data signal.

Figure 3:
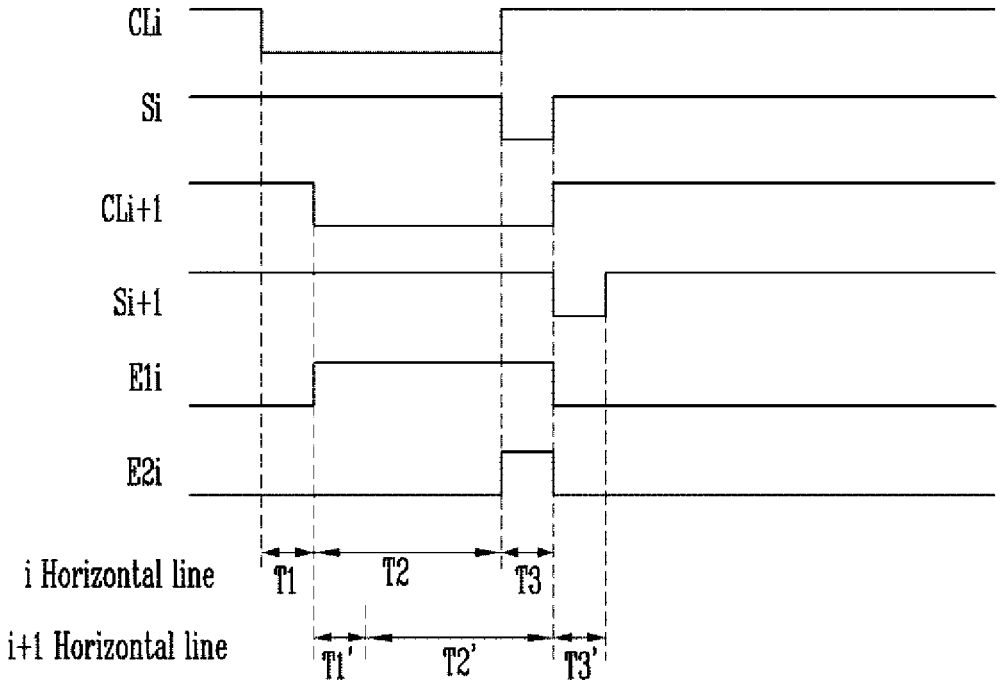
FIG. 3 is a waveform diagram showing an exemplary embodiment of a driving method of the pixel shown in FIG. 2.

FIG. 3 is a waveform diagram showing an exemplary embodiment of a driving method of the pixel shown in FIG. 2.

Referring to FIG. 3, a control signal is supplied to the i-th control line CLi for a first period T1. When the control signal is supplied to the i-th control line CLi, the third transistor M3 and the fourth transistor M4 are turned on.

When the fourth transistor M4 is turned on, a voltage of the initialization power Vint is supplied to the anode electrode of the organic light emitting diode (OLED), a parasitic capacitance of the organic light emitting diode (OLED) is discharged, and the organic light emitting diode (OLED) is initialized.

When the third transistor M3 is turned on, a voltage of the reference power Vref is supplied to the first node N1. When the voltage of the reference power Vref is supplied to the first node N1, the first transistor M1 is turned on. A current from the first power ELVDD passes through the fifth transistor M5, the first transistor M1, the sixth transistor M6, and the fourth transistor M4 to flow to the initialization power Vint.

That is, the first transistor M1 is set to an ON-bias condition for the first period T1, and a uniform luminance of an image can be displayed accordingly. More specifically, a voltage characteristic of the first transistor M1 included in the pixel 140 is set to be non-uniform corresponding to a data signal of a previous period, and thus luminance becomes non uniform. Accordingly, the voltage of the reference power Vref is supplied to the gate electrode of the driving transistor/first transistor M1 for the first period T1 to initialize the first transistor M1 to an ON-bias condition in the present embodiment, and thus uniform luminance of the image can be displayed. Additionally, because current is supplied to the initialization power Vint through the first transistor M1 for the first period T1, the organic light emitting diode (OLED) is set to a non-emitting condition.

The first light emitting control signal is supplied to the i-th first light emitting control line E1*i* for a second period T2. When the first light emitting control signal is supplied to the i-th first light emitting control line E1*i*, the fifth transistor M5 is turned off. When the fifth transistor M5 is turned off, the first power ELVDD and the third node N3 are electrically decoupled.

In this case, because the first node N1 sustains the voltage of the reference power Vref, a current from the third node N3 passes through the first transistor M1, the sixth transistor M6, and the fourth transistor M4 to flow to the initialization power Vint. The voltage of the third node N3 is dropped from the voltage of the first power ELVDD to a voltage that is the threshold voltage of the first transistor M1 added to the reference power Vref. When the voltage of the third node N3 is set to the voltage that is the threshold voltage of the first transistor M1 added to the reference power Vref, the first transistor M1 is turned off. A voltage corresponding to the threshold voltage of the first transistor M1 is charged to the first capacitor C1.

As described above, the first period T1 of the present embodiment is a period during which the ON-bias voltage is supplied to the first transistor M1, and the second period T2 is a period during which the threshold voltage of the first transistor M1 is compensated. Here, because the first period T1 and the second period T2 are not related to charging a capacitor with the data signal, the period thereof can be set to be wider. That is, the first period T1 and the second period T2 can be set long enough to be wider than a horizontal line unit, and thus the threshold voltage of the first transistor M1, included in pixels 142, can be suitably compensated for. For this purpose, the control signal supplied to the i-th control line CLi is wider than the scan signal that is supplied to the i-th scan line Si.

The scan signal is supplied to the i-th scan line Si and the control signal is not supplied to the i-th control line CLi during the third period T3. The second light emitting control signal is supplied to the i-th second light emitting control line E2*i* during the third period T3.

When the supply of the control signal to the i-th control line CLi is stopped, the third transistor M3 and the fourth transistor M4 are turned off. When the second light emitting control signal is supplied to the i-th second light emitting control line E2*i*, the sixth transistor M6 is turned off. When the sixth transistor M6 is turned off, the first transistor M1 and the organic light emitting diode (OLED) are electrically decoupled. Accordingly, the organic light emitting diode (OLED) is turned off during the third period T3.

When the scan signal is supplied to the i-th scan line Si, the second transistor M2 is turned on. When the second transistor M2 is turned on, the data signal is supplied to the first node N1 from the data line Dm. When the data signal is supplied to the first node N1, the voltage of the first node N1 is changed from the voltage of the reference voltage Vref to the voltage of the data signal. In this case, the voltage of the third node N3 is changed to correspond to the voltage change amount of the first node N1. For example, the voltage of the third node N3 is changed to the voltage corresponding to a capacitor ratio of the first capacitor C1 and the second capacitor C2. Thus, the voltage corresponding to the threshold voltage of the first transistor M1 and the data signal is charged to the first capacitor C1.

Meanwhile, the voltage corresponding to the data signal is supplied to the third node N3 through the coupling of capacitors C1 and C2 for the third period T3. When the data signal is stored corresponding to this coupling, the data signal supply time can be reduced.

After the third period, the supply of the scan signal to the i-th scan line Si is stopped, and the supply of the first light emitting control signal to the i-th first light emitting control line E1*i* is stopped. Further, after the third period the supply of the second light emitting control signal to the i-th second light emitting control line E2*i* is stopped.

When the scan signal is not supplied to the i-th scan line Si, the second transistor M2 is turned off. When the second transistor M2 is turned off, the first node N1 is set to a floating condition.

When the supply of the first light emitting control signal to the i-th first light emitting control line E1*i* is stopped, the fifth transistor M5 is turned on and the voltage of the first power ELVDD is supplied to the third node N3. In this case, because the first node N1 is set to the floating condition, the first capacitor C1 suitably sustains the voltage that is charged during the previous period. That is, the voltage that is charged in the first capacitor C1 sustains its level regardless of the voltage of the first power ELVDD, and a desirable luminance of the image can be realized regardless of the voltage drop of the first power ELVDD.

When the supply of the second light emitting control signal to the i-th second light emitting control line E2*i* is stopped, the first transistor M1 and the organic light emitting diode (OLED) are electrically connected. The first transistor M1 controls the amount of current supplied to the organic light emitting diode (OLED) corresponding to the voltage of the first node N1.

Further, pixels 140 of the present embodiment may repeat the above processes to display the image corresponding to the data signal.

Additionally, a part of the control signal supplied to the i-th control line CLi overlaps the control signal supplied to an i+1-th control line CLi+1. In this case, at least a part of the second period T2 of the i-th horizontal line overlaps a first period T1' and a second period T2' of an i+1-th horizontal line. That is, a compensation period of a previous horizontal line and a present horizontal line overlap such that the present embodiment allocates enough compensation time. Additionally, the scan signal supplied to the i-th scan line Si does not overlap a scan signal supplied to an i+1-th scan line Si+1, and thus a correct data signal is charged to each pixel.

Figure 4:
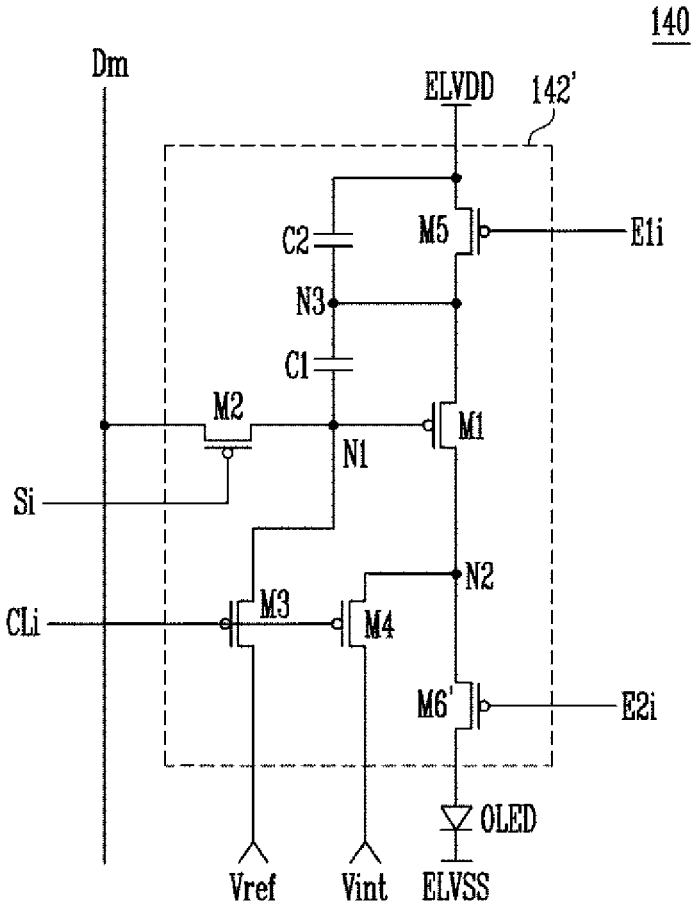
FIG. 4 is a circuit diagram showing a pixel according to another exemplary embodiment of the present invention.

FIG. 4 is a circuit diagram showing a pixel according to another exemplary embodiment of the present invention. The same constituent elements (or components) as shown in FIG. 2 are described by using the same reference numerals when FIG. 4 is described, and the repeated detailed description thereof is omitted.

Referring to FIG. 4, a pixel 140 according to another exemplary embodiment of the present invention is provided with a pixel circuit 142' for controlling an amount of current that is supplied to the organic light emitting diode (OLED).

The pixel circuit 142' includes a sixth transistor M6' that is connected between a second node N2 and the anode electrode of the organic light emitting diode (OLED), and a gate electrode of the sixth transistor M6' is connected to an i-th second light emitting control line E2*i*. This sixth transistor M6' is turned off when a second light emitting control signal is supplied to the i-th second light emitting control line E2*i*, and is turned on otherwise.

Because the sixth transistor M6' is connected between the second node N2 and the organic light emitting diode (OLED), a voltage of an initialization power Vint can be flexibly set. In other words, the voltage of the initialization power Vint can be set regardless of a turn-off of voltage of the organic light emitting diode (OLED), and thus flexibility of design can be secured. However, the voltage of the initialization power Vint is set to a lower voltage than the first power ELVDD.

Figure 5:
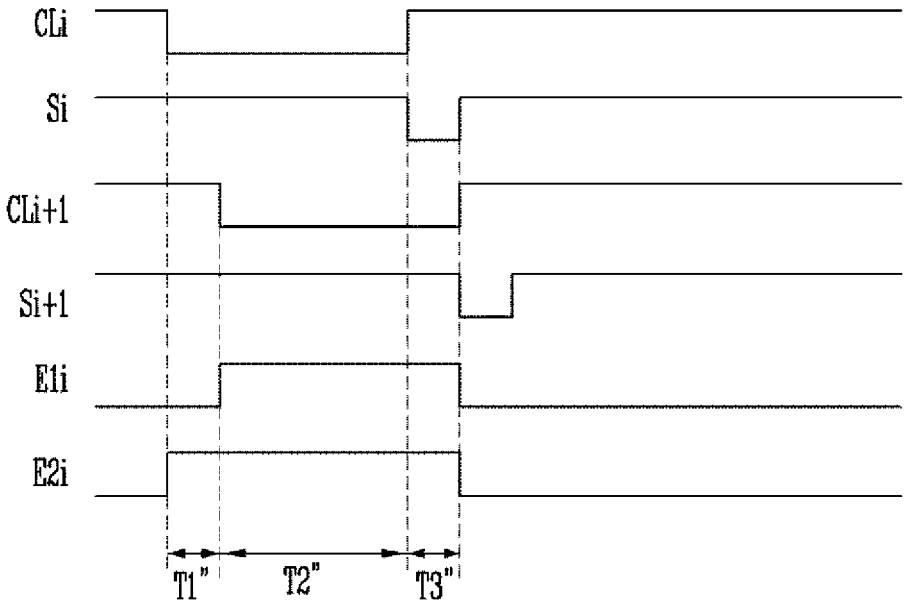
FIG. 5 is a waveform diagram showing an exemplary embodiment of a driving method of the pixel shown in FIG. 4.

FIG. 5 is a waveform diagram showing an exemplary embodiment of a driving method of the pixel shown in FIG. 4. In the present embodiment, the second light emitting control signal that is supplied to the i-th second light emitting control line E2*i* overlaps the control signal that is supplied to the i-th control line CLi, and overlaps the scan signal that is supplied to the i-th scan line Si.

Referring to FIG. 5, the control signal is supplied to the i-th control line CLi for a first period T1", and the second light emitting control signal is supplied to the i-th second light emitting control line E2*i*. When the control signal is supplied to the i-th second light emitting control line E2*i*, the sixth transistor M6' is turned off. When the sixth transistor M6' is turned off, the second node N2 and the organic light emitting diode OLED are electrically decoupled, and the organic light emitting diode OLED is set to a non-emitting condition.

When the control signal is supplied to the i-th control line CLi, a third transistor M3 and a fourth transistor M4 are turned on. When the fourth transistor M4 is turned on, the second node N2 is electrically connected with the initialization power Vint. When the third transistor M3 is turned on, the voltage of the reference power Vref is supplied to a first node N1. When the voltage of the reference power Vref is supplied to the first node N1, a first transistor M1 is turned on. A current passes through a fifth transistor M5, the first transistor M1, and the fourth transistor M4, and is supplied to the initialization power Vint from the first power ELVDD. That is, the first transistor M1 is set to an ON-bias condition for the first period T1", and thus uniform luminance of the image can be displayed.

The first light emitting control signal is supplied to the i-th first light emitting control line E1*i* for a second period T2". When the first light emitting control signal is supplied to the i-th first light emitting control line E1*i*, the fifth transistor M5 is turned off. When the fifth transistor M5 is turned off, the first power ELVDD and a third node N3 are electrically decoupled.

In this case, because the first node N1 sustains the voltage of the reference power Vref, the current from the third node N3 passes through the first transistor M1 and the fourth transistor M4 to flow to the reference power Vint. The voltage of the third node N3 drops from the first power ELVDD voltage to a voltage that is the sum of the reference power Vref and the threshold voltage of the first transistor M1. When the voltage of the third node N3 is set to the voltage that is the sum of the reference voltage Vref and the threshold voltage of the first transistor M1, the first transistor M1 is turned off. The voltage corresponding to the threshold voltage of the first transistor M1 is charged to the first capacitor C1.

As described above, the first period T1" is a period during which an ON-bias voltage is supplied to the first transistor M1, and the second period T2" is a period during which the threshold voltage of the first transistor M1 is compensated. Here, because the first period T1" and the second period T2" are not related to charging a capacitor with the data signal, the period thereof can be set to be sufficiently wide. That is, the first period T1" and the second period T2" can be set to be wider than a horizontal line unit, and thus the threshold voltage of the first transistor M1, included in pixels 140, can be suitably compensated.

For the third period T3", the scan signal is supplied to the i-th scan line Si, and the supply of the control signal to the i-th control line CLi is stopped. When the supply of control signal to the i-th control line CLi is stopped, the third transistor M3 and the fourth transistor M4 are turned off. When the scan signal is supplied to the i-th scan line Si, the second transistor M2 is turned on. When the second transistor M2 is turned on, the data signal is supplied to the first node N1 from the data line Dm. When the data signal is supplied to the first node N1, the voltage of the first node N1 is changed to the data signal voltage from the reference power Vref voltage. In this case, the voltage of the third node N3 is changed corresponding to the voltage change amount of the first node N1. For example, the voltage of the third node N3 is changed to a voltage corresponding to a capacitor ratio of the first capacitor C1 and the second capacitor C2. A voltage corresponding to the sum of the threshold voltage of the first transistor M1 and the data signal is charged to the first capacitor C1.

After the third period T3", the supply of the scan signal to the i-th scan line Si is stopped, the supply of the first light emitting control signal to the i-th first light emitting control line E1*i* is stopped, and the supply of the second light emitting control signal to the i-th second light emitting control line E2*i* is stopped.

When the supply of the scan signal to the i-th scan line Si is stopped, the second transistor M2 is turned off. When the second transistor M2 is turned off, the first node N1 is set to a floating condition.

When the supply of the first light emitting control signal to the i-th first light emitting control line E1*i* is stopped, the fifth transistor M5 is turned on, and the voltage of the first power ELVDD is supplied to the third node N3. In this case, because the first node N1 is set to the floating condition, the first capacitor C1 suitably sustains the voltage that is charged during the previous period. That is, the voltage charged in the first capacitor C1 sustains the voltage charged during the previous period regardless of the voltage of the first power ELVDD, and thus a correct luminance of the image can be realized regardless of the voltage drop of the first power ELVDD.

When the supply of the second light emitting control signal to the i-th second light emitting control line E2*i* is stopped, the first transistor M1 is electrically connected to the organic light emitting diode (OLED). The first transistor M1 controls an amount of current supplied to the organic light emitting diode (OLED) corresponding to the voltage of the first node N1. Further, pixels 140 of the present embodiment may repeat the above process to display the image corresponding to the data signal.

Additionally, the transistors are shown as PMOS for convenience of description, but the present invention is not limited thereto. In other words, in other embodiments, the transistors can be formed as NMOS.

Also, the organic light emitting diodes (OLEDs) may generate various suitable colors of light including red, green, and blue corresponding to an amount of current supplied from the driving transistors, but the present invention is not limited thereto. For example, the organic light emitting diodes (OLEDs) may generate white color light corresponding to an amount of current supplied from the driving transistors. In this case, a separate color filter may be used to realize a color image.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, components, and/or elements described in connection with a particular embodiment may be used singly or in combination with features, characteristics, components, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A pixel comprising:

an organic light emitting diode;

a first transistor configured to control an amount of current flowing from a first power through the organic light emitting diode to a second power according to a voltage of a first node;

a second transistor between a data line and the first node;

a third transistor between the first node and a reference power;

a fourth transistor between a second node and an initialization power, the second node being connected to an anode electrode of the organic light emitting diode;

a first capacitor; and a second capacitor connected in series to the first capacitor, the first and second capacitors being between the first node and the first power, wherein a third node between the first capacitor and second capacitor is electrically connected to a first electrode of the first transistor.

2. The pixel of claim 1, wherein the reference power has a voltage at which the first transistor is turned on.

3. The pixel of claim 1, wherein the initialization power has a voltage at which the organic light emitting diode is turned off.

4. The pixel of claim 1, wherein the third transistor and the fourth transistor are configured to be concurrently turned on and turned off, and wherein a turned-on period of the third and fourth transistors does not overlap a turned-on period of the second transistor.

5. The pixel of claim 4, wherein the third transistor and the fourth transistor are configured to be turned on before the second transistor is turned on.

6. The pixel of claim 1 further comprising:

a fifth transistor between the third node and the first power; and a sixth transistor between the second node and the first transistor.

7. The pixel of claim 6, wherein a turned-on period of the fifth transistor does not overlap a turned-on period of the second transistor, and wherein the fifth transistor is configured to be turned off after the third transistor is turned on.

8. The pixel of claim 6, wherein the sixth transistor is configured to be turned off when the second transistor is turned on.

9. The pixel of claim 1 further comprising:

a fifth transistor between the third node and the first power; and a sixth transistor between the second node and the organic light emitting diode.

10. The pixel of claim 9, wherein a turned-on period of the fifth transistor does not overlap a turned-on period of the second transistor, and wherein the fifth transistor is configured to be turned off after the third transistor is turned on.

11. The pixel of claim 9, wherein a turned-on period of the sixth transistor does not overlap turned-on periods of the second transistor and the third transistor.

12. An organic light emitting display device comprising:

pixels at regions defined by scan lines, data lines, control lines, first light emitting control lines, and second light emitting control lines;

a scan driver configured to supply scan signals to the scan lines;

a data driver configured to supply data signals to the data lines; and a control line driver configured to supply control signals to the control lines, wherein each of the pixels at an i-th horizontal line (i is natural number) comprises:

an organic light emitting diode;

a first transistor configured to control an amount of current that passes from a first power through the organic light emitting diode to a second power according to a voltage of a first node;

a second transistor between a data line of the data lines and the first node, and configured to be turned on when a scan signal is supplied to an i-th scan line of the scan lines;

a third transistor between the first node and a reference power, and configured to be turned on when a control signal is supplied to an i-th control line of the control lines;

a fourth transistor between an initialization power and a second node that is connected to an anode electrode of the organic light emitting diode, and configured to be turned on when the control signal is supplied to the i-th control line;

a first capacitor;

a second capacitor connected in series to the first capacitor, the first and second capacitors being between the first node and the first power; and a third node between the first capacitor and second capacitor that is electrically connected to a first electrode of the first transistor.

13. The organic light emitting display device of claim 12, wherein the reference power has a voltage at which the first transistor is turned on.

14. The organic light emitting display device of claim 12, wherein the initialization power has a voltage at which the organic light emitting diode is turned off.

15. The organic light emitting display device of claim 12, wherein the scan driver is configured to sequentially supply the scan signals to the scan lines, and wherein the control line driver is configured to supply the i-th control line with the control signal that is wider than the scan signal, and that is supplied before the scan signal is supplied to the i-th scan line.

16. The organic light emitting display device of claim 12, wherein each of the pixels at the i-th horizontal line comprises:

a fifth transistor between the third node and the first power, and configured to be turned off when a first light emitting control signal is supplied to an i-th first light emitting control line of the first light emitting control lines, and configured to be turned on otherwise; and a sixth transistor between the second node and the first transistor, and configured to be turned off when a second light emitting control signal is supplied to an i-th second light emitting control line of the second light emitting control lines, and configured to be turned on otherwise.

17. The organic light emitting display device of claim 16, further comprising an emission driver configured to:

supply the first light emitting control signal to the i-th light emitting control line such that a part of the first light emitting control signal overlaps the control signal supplied to the i-th control line, and such that another part of the first light emitting control signal overlaps the scan signal supplied to the i-th scan line; and supply the second light emitting signal to the i-th second light emitting control line such that a part of the second light emitting signal overlaps the scan signal supplied to the i-th scan line.

18. The organic light emitting display device of claim 12, wherein each of the pixels at the i-th horizontal line comprises:

a fifth transistor between the third node and the first power, and configured to be turned off when a first light emitting control signal is supplied to an i-th first light emitting control line of the first light emitting control lines, and configured to be turned on otherwise; and a sixth transistor between the second node and the anode electrode of the organic light emitting diode, and configured to be turned off when a second light emitting control signal is supplied to an i-th second light emitting control line of the second light emitting control lines, and configured to be turned on otherwise.

19. The organic light emitting display device of claim 18, further comprising an emission driver configured to:

supply the first light emitting control signal to the i-th light emitting control line such that a part of the first light emitting control signal overlaps the control signal supplied to the i-th control line, and such that another part of the first light emitting control signal overlaps the scan signal supplied to the i-th scan line; and supply the second light emitting control signal to the i-th second light emitting control line such that a part of the second light emitting control signal overlaps the control signal supplied to the i-th control line and the scan signal supplied to the i-th scan line.

* * * * *